US009637702B2

(12) United States Patent
Lancon

(10) Patent No.: US 9,637,702 B2
(45) Date of Patent: May 2, 2017

(54) LUBRICANT COMPOSITION FOR MARINE ENGINE

(71) Applicant: TOTAL MARKETING SERVICES, Puteaux (FR)

(72) Inventor: Denis Lancon, Chassieu (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 14/347,873

(22) PCT Filed: Sep. 28, 2012

(86) PCT No.: PCT/EP2012/069241
§ 371 (c)(1),
(2) Date: Mar. 27, 2014

(87) PCT Pub. No.: WO2013/045648
PCT Pub. Date: Apr. 4, 2013

(65) Prior Publication Data

US 2014/0235516 A1 Aug. 21, 2014

(30) Foreign Application Priority Data

Sep. 29, 2011 (FR) ..... 11 58738

(51) Int. Cl.

| | |
|---|---|
| ***C10M 137/10*** | (2006.01) |
| ***C10M 169/04*** | (2006.01) |
| ***C10M 173/00*** | (2006.01) |
| ***C10M 161/00*** | (2006.01) |
| ***C10M 167/00*** | (2006.01) |

(52) U.S. Cl.
CPC ..... *C10M 161/00* (2013.01); *C10M 167/00* (2013.01); *C10M 169/048* (2013.01); *C10M 2203/1006* (2013.01); *C10M 2203/1025* (2013.01); *C10M 2205/022* (2013.01); *C10M 2205/04* (2013.01); *C10M 2207/028* (2013.01); *C10M 2207/26* (2013.01); *C10M 2207/283* (2013.01); *C10M 2207/289* (2013.01); *C10M 2219/046* (2013.01); *C10M 2223/045* (2013.01); *C10N 2230/02* (2013.01); *C10N 2230/04* (2013.01); *C10N 2230/06* (2013.01); *C10N 2230/52* (2013.01); *C10N 2230/54* (2013.01); *C10N 2240/102* (2013.01); *C10N 2270/02* (2013.01)

(58) Field of Classification Search
None
See application file for complete search history.

(56) References Cited

U.S. PATENT DOCUMENTS

| | | | | |
|---|---|---|---|---|
| 5,449,470 | A | 9/1995 | Cahoon et al. | |
| 6,448,208 | B1 | 9/2002 | Dubs et al. | |
| 8,334,245 | B2 | 12/2012 | Lancon et al. | |
| 2007/0117724 | A1* | 5/2007 | Cartwright | 508/460 |
| 2008/0287329 | A1 | 11/2008 | Lancon et al. | |
| 2010/0167969 | A1 | 7/2010 | Doyen et al. | |
| 2011/0059877 | A1 | 3/2011 | Obiols et al. | |
| 2011/0077177 | A1 | 3/2011 | Doyen | |
| 2011/0105371 | A1 | 5/2011 | Duggal | |
| 2011/0143977 | A1 | 6/2011 | Cook et al. | |
| 2012/0129742 | A1 | 5/2012 | Matray et al. | |
| 2012/0157364 | A1* | 6/2012 | Kelley et al. | 508/591 |
| 2013/0244917 | A1 | 9/2013 | Obrecht et al. | |
| 2014/0041610 | A1 | 2/2014 | Lancon et al. | |

* cited by examiner

*Primary Examiner* — Vishal Vasisth
(74) *Attorney, Agent, or Firm* — Harness, Dickey & Pierce, P.L.C.

(57) ABSTRACT

A lubricant composition for 4-stroke or 2-stroke marine engine includes at least one lubricant base oil for marine engine, at least one olefin copolymer, at least one hydrogenated styrene-isoprene copolymer, at least one glycerol ester and at least one detergent, whose use promotes fuel economy and has good properties regarding engine cleanliness, in particular crankcase cleanliness.

20 Claims, No Drawings

LUBRICANT COMPOSITION FOR MARINE ENGINE

CROSS-REFERENCE TO RELATED APPLICATIONS

This application is a National Phase Entry of International Application No. PCT/EP2012/069241, filed on Sep. 28, 2012, which claims priority to French Patent Application Serial No. 1158738, filed on Sep. 29, 2011, both of which are incorporated by reference herein.

BACKGROUND

The present invention concerns a lubricant composition for marine engines, in particular for four-stroke or two-stroke marine engines, whose use promotes fuel efficiency and which has good engine cleanliness properties, in particular crankcase cleanliness.

In the automotive field, on account of environmental concerns, it is increasingly sought to reduce polluting emission and to increase fuel efficiency. The type of engine lubricant for motor vehicles has an influence on these two phenomena, and so-called "fuel-eco" engine lubricants for motor vehicles have come onto the scene. It is chiefly the quality of the lubricant bases, either alone or in combination with polymers improving the viscosity index and/or friction-modifying additives, which imparts "fuel-eco" properties to a lubricant. The savings in fuel generated through the use of "fuel-eco" lubricants are essentially obtained on cold starts when the engine has not yet reached stable mode, and not at high temperature in stabilized mode. In general, fuel economy under the NEDC cycle (New European Driving Cycle) in accordance with European Directive 70/220/CEE is 5% for cold-starts (urban cycle), 1.5% for hot engine (extra-urban cycle) with an average economy of 2.5%.

Yet, in the field of marine lubricants, marine engines operate in stabilized mode and there are very few cold starts. The "fuel-eco" solutions adapted to motor vehicle engines are therefore not adapted for marine engines. In particular, the fuel efficiency obtained in the automotive sector cannot be obtained in the marine sector. In addition, the formulation of a "fuel-eco" lubricant must not be detrimental to the other performance levels of the lubricant. In particular, wear resistance, demulsibility, neutralizing capacity and engine cleanliness (piston and/or crankcase) must not be deteriorated. It would therefore be desirable to have available a lubricant for marine engine which allows reductions in fuel consumption, whilst maintaining intact the other performing aspects of the lubricant in particular engine cleanliness and more particularly crankcase cleanliness.

SUMMARY

It is the objective of the present invention to provide a lubricant composition for marine engine which allows a reduction in fuel consumption whilst maintaining intact the cleanliness of the engine and in particular of the crankcase. In particular it is the objective of the present invention to obtain reductions in fuel consumption of at least 0.5% in comparison with an additive-free reference oil of same grade (i.e. kinematic viscosity at 100° C. of the same order of magnitude), preferably of at least 0.7%, more preferably at least 0.8%, further preferably at least 0.9% still further preferably at least 1%, yet further preferably of at least 2%, and most preferably of at least 3%. In particular, the objective of the present invention is to obtain reductions in fuel consumption such as described above, whilst maintaining good engine cleanliness, in particular good crankcase cleanliness as illustrated by a quantity of coking deposit as per the continuous ECBT test of less than 600 mg, preferably less than 550 mg, more preferably less than 500 mg, further preferably less than 450 mg, still further preferably less than 400 mg, yet further preferably of less than 350 mg, and most preferably less than 300 mg.

The applicant company has found that it is possible to formulate lubricant compositions for marine engines allowing a reduction in fuel consumption whilst maintaining engine cleanliness, in particular crankcase cleanliness equivalent to that of conventional lubricant compositions used for marine engines. This is made possible by means of a lubricant composition for 4-stroke or 2-stroke marine engine comprising at least one lubricating base oil, at least one olefin copolymer, at least one hydrogenated styrene-isoprene copolymer, at least one glycerol ester and at least one detergent.

Preferably, the olefin copolymer is a copolymer of ethylene and propylene. Preferably the hydrogenated styrene-isoprene copolymer has a quantity by weight of hydrogenated isoprene repeat units, compared to the weight of the copolymer, of between 50% and 95%. Preferably, the glycerol ester is a mixed ester of glycerol with at least one fatty acid comprising from 8 to 24 carbon atoms and at least one carboxylic acid also containing a hydroxyphenyl function.

Preferably, the detergents are chosen from among carboxylates, sulfonates and/or phenates, taken alone or in a mixture, in particular calcium carboxylates, calcium sulfonates and/or calcium phenates. Preferably the BN of the lubricant composition as determined by standard ASTM D-2896 is 5 to 100 mg KOH/g, preferably 7 to 80 mg KOH/g, more preferably 10 to 60 mg KOH/g. Preferably, the lubricant composition has a kinematic viscosity measured as per standard ASTM D7279 at 100° C. of between 5.6 and 26.1 cSt, preferably between 9.3 and 21.9 cSt, more preferably between 12.5 and 16.3 cSt. Preferably, the lubricant base oils are chosen from the base oils of Group 1 or Group 2, alone or in a mixture.

Preferably, the lubricant composition further comprises an anti-wear additive, preferably zinc dithiophosphate. The invention also concerns the use of a lubricant composition such as defined above for the lubrication of 4-stroke or 2-stroke marine engines. Preferably, the use of a lubricant composition such as defined above allows a reduction in the fuel consumption of 4-stroke or 2-stroke marine engines. Preferably, the use of a lubricant composition such as defined above allows a reduction in the fuel consumption of 4-stroke or 2-stroke marine engines whilst maintaining good engine cleanliness, preferably good crankcase cleanliness.

The invention also concerns the use of at least one glycerol ester in a lubricant composition for 2-stroke or 4-stroke marine engine comprising at least one lubricant base oil, at least one olefin copolymer, at least one hydrogenated styrene-isoprene copolymer, at least one detergent, to improve the engine cleanliness of 4-stroke or 2-stroke marine engines, preferably the cleanliness of the crankcase of 4-stroke or 2-stroke marine engines. The invention also concerns an additive concentrate containing:

a) at least one olefin copolymer,
b) at least one copolymer of styrene and hydrogenated isoprene,
c) at least one glycerol ester,
d) at least one detergent.

DETAILED DESCRIPTION

The lubricant composition of the invention contains at least one olefin copolymer (OCP). These olefin copolymers are traditionally copolymers containing ethylene repeat units and propylene repeat units, or optionally copolymers containing ethylene repeat units, propylene repeat units and diene repeat units (EPDM). Preferably, the olefin copolymer of the invention is an ethylene/propylene copolymer. The olefin copolymer of the invention is straight-chain or star-branched, preferably straight-chain. The olefin copolymer of the invention is in the form of blocks or has statistical architecture.

The olefin copolymer of the invention advantageously has an ethylene repeat unit content ranging from 5% to 75% by weight relative to the weight of the olefin copolymer, preferably from 10% to 60%, more preferably from 15% to 55%, further preferably 20% to 50%, still further preferably from 30% to 40%. The olefin copolymer of the invention advantageously has a weight average molecular weight $M_w$ of between 10,000 and 500,000 daltons, preferably of between 50,000 and 400,000, more preferably between 100,000 and 200,000, further preferably between 150,000 and 180,000. The olefin copolymer of the invention advantageously has a number average molecular weight $M_n$ of between 10,000 and 500,000 daltons, preferably of between 50,000 and 200,000, more preferably between 80,000 and 150,000, further preferably between 90,000 and 130,000. The olefin copolymer of the invention advantageously has a polydispersity index of between 1 and 4, preferably between 1.2 and 3, more preferably between 1.5 and 2, further preferably between 1.6 and 1.9.

The quantity of olefin copolymer in the lubricant composition of the invention is from 0.1% to 10% by weight relative to the total weight of the lubricant composition, preferably from 0.2% to 5%, more preferably from 0.3% to 4%, further preferably from 0.5% to 2%. This quantity is to be construed as quantity of polymer dry matter. The olefin copolymer used in the present invention is sometimes contained in dilution in a synthetic or mineral oil (most often a Group 1 oil according to the API classification).

The lubricant composition of the invention also contains at least one copolymer of styrene and hydrogenated isoprene. The hydrogenated styrene-isoprene copolymer of the invention is straight-chain or star-branched, preferably star-branched. The hydrogenated styrene-isoprene copolymer of the invention is in block form or has statistical architecture. The hydrogenated styrene-isoprene copolymer of the invention advantageously has a content of hydrogenated isoprene repeat units of 50% to 95% by weight relative to the weight of the hydrogenated styrene-isoprene copolymer, preferably of 60% to 90%, more preferably 70% to 85%, further preferably 75% to 80%.

The hydrogenated styrene-isoprene copolymer of the invention advantageously has a content of styrene repeat units ranging from 5% to 50% by weight relative to the weight of the hydrogenated styrene-isoprene copolymer, preferably from 10% to 40%, more preferably from 15% to 30%, further preferably from 20% to 25%. The hydrogenated styrene-isoprene copolymer of the invention advantageously has a weight average molecular weight $M_w$ of between 100,000 and 800,000 daltons, preferably between 200,000 and 700,000, more preferably between 300,000 and 600,000, further preferably between 400,000 and 500,000. The hydrogenated styrene-isoprene copolymer of the invention advantageously has a number average molecular weight $M_n$ of between 50,000 and 800,000 daltons, preferably between 100,000 and 600,000, more preferably between 200,000 and 500,000, further preferably between 300,000 and 400,000.

The hydrogenated styrene-isoprene copolymer of the invention advantageously has a polydispersity index of between 1 and 4, preferably between 1.2 and 3, more preferably between 1.4 and 2, further preferably between 1.5 and 1.8. The quantity of styrene and of hydrogenated isoprene copolymer in the lubricant composition of the invention is from 0.1% to 15% by weight relative to the total weight of the lubricant composition, preferably from 0.2% to 10%, more preferably from 0.3% to 8%, further preferably from 0.5% to 5%. This quantity is the dry matter quantity of polymer. The copolymer of styrene and hydrogenated isoprene used in the present invention is at times diluted in a synthetic or mineral oil (most often a Group 1 oil of the API classification). The expressions "copolymer of styrene and hydrogenated isoprene" and "hydrogenated styrene-isoprene copolymer" have the same meaning.

The lubricant composition of the invention also contains at least one glycerol ester. By glycerol ester is meant a reaction product between glycerol and one or more carboxylic acids taken alone or in a mixture. Glycerol esters are known in the field of lubricants as being friction modifiers. The applicant has ascertained that this additive has an influence on the cleanliness of an engine, in particular the cleanliness of the crankcase.

The glycerol ester of the invention is most often a mixed ester i.e. a reaction product between glycerol and several (at least two) carboxylic acids different to each other. The glycerol ester of the invention is a mixture of glycerol monoesters, diesters and/or triesters with one or more carboxylic acids taken alone or in a mixture. Since the preferred glycerol esters are mixed esters, the glycerol ester of the invention is preferably a mixture of glycerol diesters and/or triesters with at least two different carboxylic acids.

The carboxylic acids used for reaction with the glycerol are fatty acids for example, derived from oils of vegetable origin. These fatty acids are saturated, mono-unsaturated and/or poly-unsaturated fatty acids. These fatty acids comprise 6 to 24 carbon atoms, preferably 6 to 22 carbon atoms, more preferably 8 to 20 carbon atoms. Preferably the carboxylic acids used for the reaction with glycerol are used in the form of a mixture of fatty acids. The mixture of fatty acids mostly comprises saturated, mono-unsaturated and/or poly-unsaturated fatty acids comprising between 8 and 20 carbon atoms, preferably mostly saturated, mono-unsaturated and/or poly-unsaturated fatty acids with 10 to 18 carbon atoms, further preferably mostly saturated, mono-unsaturated and/or poly-unsaturated fatty acids having 12 to 16 carbon atoms. By mostly in the meaning of the present invention is meant that the sum of the saturated, mono-unsaturated and/or poly-unsaturated fatty acids comprising between 8 and 20 carbon atoms represents more than 50 weight % of the total weight of the mixture of fatty acids. The fatty acids may derive from vegetable oils such as rapeseed, sunflower, soybean, linseed, olive, palm, castor, wood, corn, pumpkin, grape-seed, jojoba, sesame, walnut, hazel nut, almond, shea, macadamia, cotton, alfalfa, rye, safflower, groundnut, coconut and copra taken alone or in mixtures. Preferably coconut oil is used.

The carboxylic acids used for reaction with the glycerol may also be carboxylic acids comprising an alkyl chain having between 1 and 6 carbon atoms linked to the acid function; the alkyl chain further comprising another function preferably a hydroxyphenyl function whether or not substituted. The alkyl chain can be straight-chain or branched.

Preferably, the alkyl chain is straight-chain. Preferably the alkyl chain comprises between 1 and 4 carbon atoms. Advantageously, the alkyl chain is a propyl chain. The hydroxyphenyl function is preferably a substituted hydroxyphenyl function. Preferably, the hydroxyphenyl function is substituted by at least one alkyl group straight-chain or branched and comprising between 1 and 6 carbon atoms. Preferably, the hydroxyphenyl function is substituted by at least one alkyl group straight-chain or branched and comprising between 1 and 4 carbon atoms. Preferably the carboxylic acid use to react with the glycerol is an alkyl carboxylic acid comprising a hydroxyphenyl function substituted by t-butyl units. Preferably, the hydroxyl function of the hydroxyphenyl is at para position relative to the alkyl carboxylic acid group which reacts with the glycerol and the t-butyl units are located at meta position. Particular mention can be made of 3-(3,5-di-tert-butyl-4-hydroxyphenyl) propionic acid, advantageously used for reaction with the glycerol. Preferably, the glycerol ester of the invention is a mixed ester of glycerol, preferably a mixed ester of at least one fatty acid and at least one carboxylic acid comprising a hydroxyphenyl function such as defined above.

The quantity of glycerol ester in the lubricant composition of the invention is from 0.1% to 5% by weight, relative to the total weight of the lubricant composition, preferably from 0.2% to 4%, more preferably from 0.5% to 2%, further preferably from 1% to 1.5%. This quantity is the dry matter quantity of the product. The glycerol ester used in the present invention is at times diluted in a mineral or synthetic oil of paraffin type (most often oil containing aliphatic cycloparaffinic hydrocarbons).

The detergents used in the lubricant compositions of the present invention are well known to persons skilled in the art. The detergents commonly used in the formulation of lubricant compositions are typically anionic compounds comprising a lipophilic hydrocarbon long chain and a hydrophilic head. The associated cation is typically a metal cation of an alkaline or alkaline-earth metal.

The detergents of the invention are chosen from among alkaline or alkaline-earth metal salts of carboxylic acids, of sulfonates, salicylates, naphthenates and phenates taken alone or in a mixture. The detergents are designated according to the type of hydrophobic chain: carboxylate, sulfonate, salicylate, naphthenate or phenate. The alkaline and alkaline-earth metals are preferably calcium, magnesium, sodium or barium, more preferably calcium.

The detergents used are non-overbased (or neutral) or overbased. A detergent is said to be non-overbased or "neutral" when the metal salts contain the metal in approximately stoichiometric quantity. A detergent is said to be overbased if the metal is in excess (in greater quantity than the stoichiometric quantity). The excess metal imparting the overbased nature to a detergent is in the form of oil-insoluble metal salts. Overbased detergents are therefore in the form of micelles composed of insoluble metal salts held in suspension in the lubricant composition by the detergents in the form of oil-soluble metal salts. These micelles may contain one or more types of insoluble metal salts, stabilized by one or more types of detergents. The overbased detergents are said to be of mixed type if the micelles comprise several types of detergents differing from each other through their type of hydrophobic chain.

The preferred detergents are carboxylates, sulfonates and/or phenates, taken alone or in a mixture, in particular calcium carboxylates, sulfonates and/or phenates. The quantity of detergents in the lubricant composition of the invention is from 1% to 20% by weight relative to the total weight of the lubricant composition, preferably from 2% to 10%, more preferably from 4% to 15%, further preferably from 5% to 10%.

The BN (Base Number measured in accordance with ASTM D-2896) of the lubricant compositions of the present invention is provided by the neutral or overbased detergents containing alkaline or alkaline-earth metals. The BN value of the lubricant compositions of the present invention, measured in accordance with ASTM D-2896, may vary from 5 to 100 mg KOH/g, preferably from 7 to 80 mg KOH/g, more preferably from 10 to 60 mg de KOH/g. The BN value is to be chosen in relation to the conditions of use of the lubricant compositions and in particular to the sulfur content of the fuel used. For example, for fuels with a high sulfur content (of the order of 0.2% to 4.5 weight %), the BN value will be high and preferably between 20 and 80 mg KOH/g, more preferably between 30 and 65 mg KOH/g. For fuels with low sulfur content (of the order of 0.05% to 0.2 weight %), the BN value will be low and preferably between 5 and 20 mg KOH/g, more preferably between 10 and 15 mg KOH/g.

In the remainder of the present invention, the term essential additives will be used for those additives described above i.e. a) at least one olefin copolymer, b) at least one copolymer of styrene and hydrogenated isoprene, c) at least one glycerol ester and d) at least one detergent such as defined above. In general, the base oils used for the formulation of the lubricant compositions of the present invention can be oils of mineral, synthetic or vegetable origin and mixtures thereof.

The mineral or synthetic oils generally used in the application belong to one of the classes defined under the API classification such as summarized in the table below.

| | Saturate content | Sulfur content | Viscosity Index (VI) |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydro-isomerized oils | ≥90% | ≤0.03% | ≥120 |
| Group 4 | Poly-Alpha-Olefins (PAO) | | |
| Group 5 | Other bases not included in bases of Groups 1 to 4 | | |

The mineral oils in Group 1 can be obtained by distillation of selected naphthenic or paraffinic crude oils then purifying these distillates using processes such as solvent extraction, solvent or catalytic de-waxing, hydro-treatment or hydrogenation. The mineral bases in Group 1 are for example the bases called Neutral Solvent (e.g. 150NS, 330NS, 500NS or 600NS) or Brightstock. The oils in Group 2 and 3 are obtained using more severe purification processes, for example a combination from among hydro-treatment, hydrocracking, hydrogenation and catalytic de-waxing.

Examples of synthetic bases in Groups 4 and 5 include poly-alpha-olefins, polybutenes, polyisobutenes, alkylbenzenes. These base oils can be used alone or in a mixture. A mineral oil can be combined with a synthetic oil.

The lubricant compositions of the invention have a viscosity grade of SAE-20, SAE-30, SAE-40, SAE-50 or SAE-60 according to the SAEJ300 classification. Grade 20 oils have a kinematic viscosity at 100° C. of between 5.6 and 9.3 cSt. Grade 30 oils have a kinematic viscosity at 100° C. of between 9.3 and 12.5 cSt. Grade 40 oils have a kinematic viscosity at 100° C. of between 12.5 and 16.3 cSt. Grade 50 oils have a kinematic viscosity at 100° C. of between 16.3 and 21.9 cSt. Grade 60 oils have a kinematic viscosity at 100° C. of between 21.9 and 26.1 cSt.

The quantity of base oil in the lubricant composition of the invention is from 30% to 80% by weight relative to the total weight of the lubricant composition, preferably from 40% to 70%, more preferably from 50% to 60%. It is optionally possible to substitute the above-described base oils in full or in part by one or more thickening additives whose role is to increase both the hot and cold viscosity of the composition, or by additives improving the viscosity index (VI) such as polyisobutylenes (PIB). In addition to the essential additives such as described above, the composition of the invention may comprise at least one optional additive, chosen in particular from among those frequently used by persons skilled in the art. For example the optional additive may be an anti-wear additive and/or a dispersing additive and/or an anti-foaming additive or a mixture thereof.

Anti-wear additives protect surfaces against friction through the formation of a protective film adsorbed on these surfaces. There is a wide variety of anti-wear additives. For example mention can be made of phosphor-sulfur additives such as metal alkylthiophosphates, in particular zinc alkylthiophosphates, and more specifically zinc dialkyldithiophosphates (or ZnDTP). The alkyl groups of these zinc dialkyldithiophosphates preferably comprise 1 to 18 carbon atoms. Amine phosphates, polysulfides in particular sulfur-containing olefins, are also frequently used anti-wear additives. Anti-wear additives of nitrogen-containing or sulfur-containing type can also be found, such as metal dithiocarbamates, in particular molybdenum dithiocarbamates. The preferred anti-wear additive is ZnDTP. The quantity of anti-wear additive in the lubricant of the invention is 0.1% to 5% by weight relative to the total weight of the lubricant composition, preferably from 0.2% to 4%, more preferably 0.5% to 2%, further preferably 0.4% to 1%.

Dispersants are well-known additives used in the formulation of lubricant compositions, in particular for application in the marine sector. Their primary role is to maintain in suspension those particles initially present or which occur in the lubricant composition through engine use. They prevent the agglomeration thereof by acting on steric hindrance. They may also have a synergic effect on neutralization. The dispersants used as lubricant additives typically contain a polar group, associated with a relatively long hydrocarbon chain generally having 50 to 400 carbon atoms. The polar group typically contains at least one element, nitrogen, oxygen or phosphorus.

The compounds derived from succinic acid are dispersants given particular use as lubricating additives. In particular dispersants from the family of succinimides are used, obtained by condensation of succinic anhydrides and amines, the succinic esters obtained by condensation of succinic anhydrides and alcohols or polyols. These compounds may then be treated with various compounds, in particular sulfur, oxygen, formaldehyde, carboxylic acids and boron- or zinc-containing compounds to produce boronated succinimides for example or zinc-blocked succinimides. Mannich bases obtained by polycondensation of alkyl-group substituted phenols, of formaldehyde and of primary or secondary amines are also compounds used as dispersants in lubricants.

According to one embodiment of the present invention, at least 0.1 weight % of a dispersant additive is used relative to the total weight of the lubricant composition. It is possible to use a dispersant from the PIB succinimide family, e.g. boronated or zinc-blocked. Preferably, 0.1% to 5 weight % of a dispersant additive is used relative to the total weight of the lubricant composition, preferably from 0.2% to 4%, more preferably from 0.5% to 2%, further preferably from 0.4% to 1%.

The lubricant composition of the present invention may also contain any functional additive adapted to the use thereof, for example anti-foaming additives to counter the effect of the detergents, which may be polar polymers for example such as polymethylsiloxanes, polyacrylates, anti-oxidant and/or anti-rust additives, e.g. organometallic detergents or thiadiazoles, pour point depressants (PPD). These are known to those skilled in the art. These additives are generally present at a weight content of 0.1 to 5% relative to the total weight of the lubricant composition.

The essential additives such as defined above contained in the lubricant compositions of the present invention can be incorporated in the lubricant composition as separate additives, in particular through separate addition thereof in the base oils. However, they may also be integrated in a concentrate of additives for marine lubricant composition.

A further subject of the invention is a concentrate containing at least the essential additives described above without the base oils, in particular a) at least one olefin copolymer, b) at least one hydrogenated styrene-isoprene copolymer, c) at least one glycerol ester and d) at least one detergent. The concentrate of additives is formulated such that the pumpability limits are heeded for the pumps usually used. The concentrate of additives may further comprise at least one optional additive such as described above and chosen from among anti-wear additives and/or dispersant additives and/or anti-foaming additives or mixtures thereof, in particular anti-wear such as ZnDTP.

The quantity of olefin copolymer in the additive concentrate is 2 to 20% by weight relative to the total weight of the concentrate, preferably 5 to 15%, more preferably 8 to 12%. The quantity of hydrogenated styrene-isoprene copolymer in the additive concentrate is 5 to 30% by weight relative to the total weight of the concentrate, preferably from 10 to 25%, more preferably from 15 to 20%. The quantity of glycerol ester in the additive concentrate is from 0.5 to 10% by weight relative to the total weight of concentrate, preferably from 1 to 8%, more preferably from 2 to 5%. The quantity of detergent in the additive concentrate is from 10 to 70% by weigh relative to the total weight of concentrate, preferably from 20 to 60%, more preferably 30 to 50%. The concentrates of the invention are diluted 4 to 5 times in a base oil or in a mixture of base oils to obtain the lubricant compositions of the invention.

The lubricant composition of the invention can be used in 4-stroke or 2-stroke marine engines. In particular, the lubricant composition is suitable for high speed or medium speed 4-stroke engines which respectively use distillates and bunker fuel or heavy fuel. The fuel economy observed also applies to the distillates used in high-speed 4-stroke engines. High speed 4-stroke engines are used to propel ships of low tonnage and as electricity generating units on board larger vessels. Medium speed 4-stroke engines are used to propel numerous vessels such as cargo ships, tankers, ferries, even some container carriers. They may also be used as electricity generating units on board large-size vessels or in diesel-electric units. In particular, the lubricant composition is suitable for 4-stroke engines and for 2-stroke engines as cylinder oil or system oil, in particular as system oil.

A further subject of the invention concerns a lubrication method for marine engine, the said method comprising a step to contact the engine with the lubricant composition such as described in the foregoing or obtained from the additive concentrate such as described in the foregoing. A further subject of the invention concerns a method for reducing fuel consumption comprising the contacting of the lubricant composition such as defined above or obtained from the concentrate such as defined above with a marine engine.

EXAMPLES

Different lubricant compositions were prepared from the following compounds:

- a hydrogenated styrene-isoprene copolymer (HSI), star-branched, comprising 90 weight % hydrogenated isoprene repeat units and 10 weight % styrene repeat units, with weight average molecular weight Mw of 605 000, number average molecular weight Mn of 439 500, polydispersity index of 1.4, the commercial copolymer is diluted to 10.7 weight % in a Group 1 base oil;
- an olefin copolymer (OCP), straight-chain, comprising 50 weight % ethylene repeat units, with weight average molecular weight Mw of 171 700, number average molecular weight Mn of 91 120, polydispersity index of 1.9, the commercial copolymer is diluted to 12.5 weight % in a Group 1 base oil;
- a glycerol ester, in particular a mixed ester of glycerol and C8-C18 fatty acids, and 3-(3,5-di-tert-butyl-4-hydroxyphenyl) propionic acid, the commercial ester is diluted to 80 weight % in an aliphatic cycloparaffinic hydrocarbon;
- a packet comprising detergents containing calcium carboxylates, calcium sulfonates and calcium phenates and an anti-wear additive, zinc dithiophosphate (ZnDTP), the packet being diluted to 50 weight % in a Group 1 base oil;
- Group 1 base oils, in particular bases called Neutral Solvent 150NS, 330NS or 600 NS, of respective viscosity at 40° C. of 30 cSt, 66 cSt or 120 cSt.

The percentage quantities of the different constituents are given in Table 1 below; these are weight % values of the products used in dilution and not weight percentages of active matter:

TABLE 1

| Compositions | $L_1$ | $L_2$ | $L_3$ | $L_4$ | $L_5$ | $L_6$ |
|---|---|---|---|---|---|---|
| HSI | 5 | — | 5 | — | 5 | 5 |
| OCP | — | 2.5 | — | 2.5 | 2.5 | 2.5 |
| Glycerol ester | — | — | 1 | 1 | — | 1 |
| Detergent | 12.7 | 12.7 | 12.7 | 12.7 | 12.7 | 12.7 |
| ZnDTP | 0.5 | 0.5 | 0.5 | 0.5 | 0.5 | 0.5 |
| 150NS | — | — | — | — | 27.3 | 27.3 |
| 330NS | 81.8 | 30.9 | 80.8 | 30.9 | 52.0 | 51.0 |
| 600NS | — | 53.4 | — | 52.4 | — | — |

The physicochemical properties of the lubricant compositions are grouped together in Table II below:

TABLE II

| Compositions | $L_1$ | $L_2$ | $L_3$ | $L_4$ | $L_5$ | $L_6$ |
|---|---|---|---|---|---|---|
| KV 100° C. (cSt)(1) | 13.81 | 14.31 | 13.79 | 14.33 | 14.30 | 14.36 |
| KV 40° C. (cSt)(1) | 114.3 | 129.9 | 114.2 | 130.0 | 109.3 | 109.5 |
| VI | 120 | 109 | 120 | 109 | 133 | 134 |
| BN (mg KOH/g)(2) | 30.2 | 28.9 | 20.1 | 29.9 | 29.7 | 29.8 |

TABLE II-continued

| Compositions | $L_1$ | $L_2$ | $L_3$ | $L_4$ | $L_5$ | $L_6$ |
|---|---|---|---|---|---|---|
| KV 100° C. of bases (cSt)(1) | 8.0 | 10.6 | 8.0 | 10.6 | 7.0 | 7.0 |
| HTHS 150° C.(3) | 3.8 | 4.1 | 3.8 | 4.1 | 3.85 | 3.85 |

(1)ASTM D7279
(2)ASTM D2896
(3)ASTM D4683

The "fuel eco" properties of the lubricant compositions were then evaluated and validated by testing on a test bench equipped with a MAN 5L16/24 engine. The particular characteristics of this engine have been described in the publication "INNOVATOR-4C, The cutting-edge MAN B&W 5L16/24 test engine", by D. Lançon, V. Doyen and J. Christensen, CIMAC Congress 2004, KYOTO (Paper 124).

Dedicated stabilized cycle procedure was developed to measure the "fuel eco" properties of the lubricant compositions following the description below. This procedure had recourse to equipment usually found in test centres with engine test bench:

- Rinsing the engine and lubrication circuits with the candidate lubricant.
- Running-in the engine with the candidate lubricant.
- Measuring fuel consumption of distillate type (Marine Diesel Oil—as per specification ISO8217). Measurements are repeated to ensure accuracy.
- The fuel consumptions obtained with the candidate lubricant are compared with those obtained for a tested reference lubricant.
- Engine operating conditions:
  - Speed: 1000 rpm
  - Developed power: 334 kW, i.e. 75% of maximum power
  - Lubricant temperature on entering the engine: 68-70° C.
  - Volume of lubricant: 2×200 liters
- The tests are organized around a precise protocol which consists of placing any test performed with a candidate lubricant between two tests performed with the reference lubricant. This allows the guaranteed operating stability of the engine and the statistically significant nature of the measured differences in consumption between lubricants.
- In the case in hand, the reference lubricant was a commercial oil for medium speed engine of viscosity grade SAE40 and BN 30.

The heat resistance of these compositions was also measured using the continuous coking ECBT test, wherein the weight of generated deposits (in mg) is measured under determined conditions. The lower this weight the better the heat resistance. With this test it is possible to simulate the heat stability and detergency of marine lubricants, and therefore allows the determination and simulation of engine cleanliness.

The test uses beakers in aluminium which simulate the shape of pistons. These beakers are placed in a glass container held at controlled temperature of the order of 60° C. The lubricant is placed in these containers themselves equipped with a metal brush partly immersed in the lubricant. This brush is driven by a rotational movement at a speed of 1000 rotations per minute, which causes spraying of lubricant onto the lower surface of the beaker. The beaker is held at a temperature of 310° C. using an electrical heating resistance with thermocouple regulation.

In the applied procedure called Continuous ECBT the test lasts 12 hours and the spraying of lubricant is continuous. This procedure simulates the formation of deposits in the piston-segment assembly. The result is the weight of deposit measured on the beaker. A detailed description of this test is given in the publication "Research and Development of Marine Lubricants in ELF ANTAR France—The relevance of laboratory tests in simulating field performance" by Jean-Philippe ROMAN, MARINE PROPULSION CONFERENCE 2000—AMSTERDAM—29-30 Mar. 2000.

The results are grouped together in Table III below.

TABLE III

| Compositions | $L_1$ | $L_2$ | $L_3$ | $L_4$ | $L_5$ | $L_6$ |
|---|---|---|---|---|---|---|
| Fuel reduction (%) | 0.5 | 0.2 | 0.5 | 0.2 | 0.7 | 0.7 |
| ECBT (mg) | 365 | 335 | 355 | 330 | 600 | 430 |

It is ascertained that the combination of a hydrogenated styrene-isoprene copolymer and an olefin copolymer, in lubricant compositions $L_5$ and $L_6$, allows a 0.7% reduction in fuel consumption under 75% loading relative to the reference oil. The weight of the deposits of the lubricant composition $L_5$ is high compared with that of the lubricant composition $L_6$. The addition of the glycerol ester ensures satisfactory crankcase cleanliness. Additivation using a combination of a hydrogenated styrene-isoprene copolymer, an olefin copolymer and a glycerol ester therefore allows the formulating of a "fuel eco" marine lubricant whilst maintaining good crankcase cleanliness.

The invention claimed is:

1. A lubricant composition for 4-stroke or 2-stroke marine engine, comprising:

a) at least one lubricating base oil, b) from 0.2 to 2% by weight of at least one olefin copolymer, wherein the olefin copolymer is a straight-chain copolymer of ethylene and propylene, c) from 0.3 to 5% by weight of at least one copolymer of styrene and hydrogenated isoprene, d) from 0.5 to 1.5% by weight of at least one glycerol ester, wherein the glycerol ester is a mixed ester of glycerol with at least one fatty acid having 8 to 24 carbon atoms and at least one carboxylic acid also comprising a hydroxyphenyl function, and e) from 5 to 10% by weight of at least one detergent, based on the total weight of the lubricant composition.

2. The lubricant composition according to claim 1 wherein the hydrogenated styrene-isoprene copolymer has a quantity by weight of hydrogenated isoprene repeat units relative to the weight of the copolymer of between 50% and 95%.

3. The lubricant composition according to claim 1 wherein the detergents are chosen from among carboxylates, sulfonates and/or phenates, taken alone or in a mixture.

4. The lubricant composition according to claim 1 having a BN determined as per standard ASTM D-2896 of 5 to 100 mg KOH/g.

5. The lubricant composition according to claim 1 having a kinematic viscosity measured as per standard ASTM D7279 at 100° C. of between 5.6 and 26.1 cSt.

6. The lubricant composition according to claim 1 wherein the lubricant base oils are chosen from among the base oils of Group 1 or Group 2, taken alone or in a mixture.

7. The lubricant composition according to claim 1 further comprising an anti-wear additive including zinc dithiophosphate.

8. The use of a lubricant composition according to claim 1 for lubricating 4-stroke or 2-stroke marine engines.

9. The use of a lubricant composition according to claim 1, wherein the composition reduces fuel consumption of 4-stroke or 2-stroke marine engines.

10. A method of using a lubricant composition, the method comprising:

using at least one glycerol ester, wherein the glycerol ester is a mixed ester of glycerol with at least one fatty acid having 8 to 24 carbon atoms and at least one carboxylic acid also comprising a hydroxyphenyl function and wherein the glycerol ester is from 0.5 to 1.5% by weight of the lubricant composition, of the lubricant composition in a 2-stroke or 4-stroke marine engine, the lubricant composition further comprising at least one lubricant base oil, from 0.2 to 2% by weight of at least one olefin copolymer wherein the olefin copolymer is a straight-chain copolymer of ethylene and propylene, from 0.3 to 5% by weight of at least one hydrogenated styrene-isoprene copolymer, and from 5 to 10% by weight of at least one detergent, based on the total weight of the lubricant composition; and improving the engine or a crankcase cleanliness of the 4-stroke or 2-stroke marine engine.

11. A concentrate of additives comprising:

a) from 2 to 20% by weight of at least one olefin copolymer, wherein the olefin copolymer is a straight-chain copolymer of ethylene and propylene, b) from 5 to 30% by weight of at least one copolymer of styrene and hydrogenated isoprene, c) from 0.5 to 10% by weight of at least one glycerol ester, wherein the glycerol ester is a mixed ester of glycerol with a least one fatty acid having 8 to 24 carbon atoms and at least one carboxylic acid also comprising a hydroxyphenyl function, and d) from 10 to 70% by weight of at least one detergent, based on the total weight of the concentrate of additives, wherein the concentrate of additives is a 4× to 5× concentrate for dilution in a base oil or in a mixture of base oils.

12. The lubricant composition according to claim 1 wherein the detergents are chosen from among calcium carboxylates, calcium sulfonates and/or calcium phenates, taken alone or in a mixture.

13. The lubricant composition according to claim 1 having a BN determined as per standard ASTM D-2896 of 7 to 80 mg KOH/g.

14. The lubricant composition according to claim 1 having a BN determined as per standard ASTM D-2896 of 10 to 60 mg KOH/g.

15. The lubricant composition according to claim 1 having a kinematic viscosity measured as per standard ASTM D7279 at 100° C. of between 9.3 and 21.9 cSt.

16. The lubricant composition according to claim 1 having a kinematic viscosity measured as per standard ASTM D7279 at 100° C. of between 12.5 and 16.3 cSt.

17. A lubricant composition for 4-stroke or 2-stroke marine engine comprising:

51% by weight of a Group 1 base oil called Neutral Solvent 150NS of viscosity at 40° C. of 30 cSt;

27.3% by weight of a Group 1 base oil called Neutral Solvent 330NS of viscosity at 40° C. of 66 cSt;

2.5% by weight of a straight-chain olefin copolymer comprising 50 weight % of ethylene repeat units and having a weight average molecular weight Mw of 171 700, a number average molecular weight Mn of 91 120, a polydispersity index of 1.9, the olefin copolymer being diluted to 12.5 weight % in a Group 1 base oil;

5% by weight of a star-branched copolymer of styrene and hydrogenated isoprene, comprising 90 weight % of hydrogenated isoprene repeat units and 10 weight % styrene repeat units, and having a weight average molecular weight Mw of 605 000, a number average molecular weight Mn of 439 500, a polydispersity index of 1.4, the copolymer being diluted to 10.7 weight % in a Group 1 base oil;

1% by weight of a mixed ester of glycerol and C8-C18 fatty acids, and 3-(3,5-di-tert-butyl-4-hydroxyphenyl) propionic acid, the mixed ester being diluted to 80 weight % in an aliphatic cycloparaffinic hydrocarbon;

12.7% by weight of detergents containing calcium carboxylates, calcium sulfonates and calcium phenates, the packet being diluted to 50 weight % in a Group 1 base oil.

18. The lubricant composition according to claim 1 wherein the quantity of the olefin copolymer ranges from 0.2 to 0.5% by weight, based on the total weight of the lubricant composition.

19. The lubricant composition according to claim 1 wherein the quantity of the glycerol ester ranges from 0.5 to 1% by weight, based on the total weight of the lubricant composition.

20. The lubricant composition according to claim 1 wherein the quantity of the olefin copolymer ranges from 0.2 to 0.5% by weight and the quantity of the glycerol ester ranges from 0.5 to 1% by weight, based on the total weight of the lubricant composition.

* * * * *